US007160400B2

(12) United States Patent
Magoshi et al.

(10) Patent No.: US 7,160,400 B2
(45) Date of Patent: Jan. 9, 2007

(54) LOW THERMAL EXPANSION NI-BASE SUPERALLOY

(75) Inventors: Ryotaro Magoshi, Hyogo (JP); Hisataka Kawai, Hyogo (JP); Yoshikuni Kadoya, Hyogo (JP); Ryuichi Yamamoto, Hyogo (JP); Toshiharu Noda, Gifu (JP); Susumu Isobe, Aichi (JP); Michio Okabe, Aichi (JP)

(73) Assignees: Daido Tokushuko Kabushiki Kaisha, Nagoya (JP); Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 10/255,716

(22) Filed: Sep. 27, 2002

(65) Prior Publication Data

US 2003/0155047 A1 Aug. 21, 2003

Related U.S. Application Data

(63) Continuation-in-part of application No. 09/517,305, filed on Mar. 2, 2000, now abandoned.

(30) Foreign Application Priority Data

Mar. 3, 1999 (JP) ..... 11-56059

(51) Int. Cl.
*C22C 19/05* (2006.01)

(52) U.S. Cl. ..... 148/410; 148/428; 420/448; 420/450

(58) Field of Classification Search ..... 148/428; 420/448

See application file for complete search history.

(56) References Cited

U.S. PATENT DOCUMENTS

| | | | | |
|---|---|---|---|---|
| 4,818,486 | A * | 4/1989 | Rothman et al. | 420/442 |
| 5,130,089 | A * | 7/1992 | Henry | 420/448 |
| 5,556,594 | A * | 9/1996 | Frank et al. | 420/448 |
| 5,938,863 | A * | 8/1999 | Malley | 148/428 |

FOREIGN PATENT DOCUMENTS

| | | | |
|---|---|---|---|
| FR | 2 665 077 | A1 * | 1/1992 |
| JP | 53-097926 | A * | 8/1978 |
| JP | 10-317079 | A * | 12/1998 |

OTHER PUBLICATIONS

Patent Abstracts of Japan, Oct. 31, 1997 & JP 09 157779 A (Hitachi Metals Ltd), Jun. 17, 1997.
Patent Abstracts of Japan, Nov. 20, 1986 & JP 61 147834 A (Hitachi Metals Ltd), Jul. 5, 1986.
Patent Abstracts of Japan, May 31, 1996 & JP 08 003665 A (Mitsubishi Materials Corp), Jan. 9, 1996.
Patent Abstracts of Japan, Apr. 30, 1988 & JP 62 260033 A (Mitsubishi Metal Corp), Nov. 12, 1987.
Patent Abstracts of Japan, May 18, 1990 & JP 02 061019 A (Mitsubishi Steel Mfg Co Ltd; Others: 01), Mar. 1, 1990.

* cited by examiner

*Primary Examiner*—Harry D Wilkins, III
(74) *Attorney, Agent, or Firm*—Bacon & Thomas PLLC

(57) ABSTRACT

A low thermal expansion Ni-base superalloy contains, by weight % (hereinafter the same as long as not particularly defined) C: 0.15% or less; Si: 1% or less; Mn: 1% or less; Cr: 5 to 20%; at least one of Mo, W and Re of Mo+½(W+Re) of 17 (exclusive) to 25%; Al: 0.2 to 2%; Ti: 0.5 to 4.5%; Fe of 10% or less; at least one of B: 0.02% and Zr: 0.2% or less; a remainder of Ni and inevitable impurities; wherein the atomic % of Al+Ti is 2.5 to 7.0.

9 Claims, 1 Drawing Sheet

LOW THERMAL EXPANSION NI-BASE SUPERALLOY

CROSS-REFERENCE TO RELATED APPLICATION

This application is a continuation-in-part of application Ser. No. 09/517,305, filed Mar. 2, 2000 now abandoned, the entire disclosure of which is herein incorporated by reference.

BACKGROUND OF THE INVENTION

1. Field of the Invention

The present invention relates to a low thermal expansion Ni superalloy, and more particularly to a low thermal expansion Ni superalloy having high strength and excellent corrosion-resistance and oxidation-resistance.

2. Description of the Related Art

In recent years, the bolt material for high temperature use in a pressure vessel member which is heated to high temperature, such as a chamber of a steam turbine and gas turbine is made of 12 Cr ferritic steel (containing C: 0.12%, Si: 0.04%, Mn: 0.7%, P: 0.1%, Ni: 0.4%, Cr: 10.5%, Mo: 0.5%, Cu: 0.03%, V: 0.2%, W: 1.7%, Nb: 0.% and Fe: remaining percent) or austenitic heat-resistant alloy (Nimonic alloy 80A including Cr: 20.5%, Mn: 0.4%, Al: 1.4%, Ti: 2.4%, Si: 0.3%, C: 0.06 Zr: 0.06%, B: 0.003%, Ni: remaining percent, and Refrataloy 26 including Cr: 18%, Co: 20%, Mo: 3%, Ti: 2.6%, Fe: 16%, C: 0.05%, Ni: remaining percent).

In recent years, in order to improve the thermal efficiency of a steam turbine, the steam temperature has been further increased so that the high temperature bolt has been used under more severe conditions. Where each of the materials described above is used for the high temperature bolt under such a severe condition, 12 Cr ferritic steel is low in cost and excellent in production. However, if the steam temperature becomes higher than at present, the material is low in strength at the high temperature. On the other hand, austenitic heat-resistant alloy is better in the corrosion-resistance and oxidation-resistance than the 12 Cr ferritic steel, and high in the high temperature strength. However, because it has a higher linear expansion coefficient than that of 12 Cr ferritic steel, it may produce leakage of steam due to insufficient tightening of the bolt, and generate thermal fatigue. Therefore, austenitic heat-resistance alloy is also problematic as a material used at higher temperatures.

JP-A-9-157779 discloses a low thermal expansion Ni-base super heat-resistant alloy with excellent corrosion-resistance and oxidation-resistance containing, by weight %, C of 0.2% or less, Si of 1% or less, Mn of 1% or less, Cr of 10 to 24%, one or more kinds of Mo and W of Mo+½ W of 5 to 17%, Al of 0.5 to 2%, Ti of 1 to 3%, Fe of 10% or less, B of 0.02 or less and Zr of 0.2% or less, and as necessary Co of 5% or less and Nb of 1.0% or less and remainder of Ni and inevitable impurities. JP-A-8-85838 also discloses a similar alloy.

A previously known example of alloys having a low linear expansion coefficient is Inconel 783 of an Invar alloy (containing Cr: 3.21%, Mn: 0.08%, Al: 5.4%, Ti: 0.2%, Si: 0.07%, C: 0.03%, B: 0.003%, Fe: 24.5%, Ni: 28.2% and Co: 35.3% . . . Comparative Example No. 2) which has been developed as the material for a jet engine. This alloy has a low linear expansion coefficient in a ferromagnetic state with the Curie point adjusted in the balance of Fe—Ni—Co.

However, this alloy does not have enough corrosion-resistance to be used for the steam turbine.

SUMMARY OF THE INVENTION

It is an object of the present invention to provide a low expansion Ni-base superalloy having a linear expansion coefficient approximately equal to 12 Cr ferritic steel, high-temperature strength and corrosion/oxidation-resistance approximately equal to the above austenite heat-resistant alloy.

In order to solve the above problems, the inventors have diligently investigated the low linear expansion Ni-base superalloy strengthened by co-precipitation of y' phase and $A_2B$ phase. As a result, the inventors found that as regards Mo, W and Re, when the value represented by Mo+½ (W+Re) is more than 17% the target thermal expansion coefficient can be obtained. In order to increase the thermal expansion coefficient in this case, Cr should be 20% or less; the thermal expansion coefficient further lowers where Cr is lower than 10%; and even if Cr is lower than that of a conventional Ni-base heat-resistant alloy, a problem of steam oxidation does not occur, and the inventors have accomplished the present invention on the basis of these findings.

A low thermal expansion Ni-base superalloy of the present invention comprises, by weight % (hereinafter the same as long as not particularly defined), C: 0.15% or less; Si: 1% or less; Mn: 1% or less; Cr: 5 to 20%; at least one of Mo, W and Re of Mo+½ (W+Re) of 17 (exclusive) to 25%; Al: 0.2 to 2%; Ti: 0.5 to 4.5%; Fe of 10% or less; at least one of B: 0.02% and Zr: 0.2% or less; a remainder of Ni and inevitable impurities; wherein the atomic % of Al+Ti is 2.5 to 7.0.

In the low thermal expansion Ni-base superalloy of the present invention, it is preferable that the amount of Cr is from 5 to 10 (exclusive) %; wherein the amount of Al is from 0.2 to 0.4 (exclusive) %; and/or the amount of Ti is from 3.5 (exclusive) to 4.5%.

The low thermal expansion Ni-base superalloy may further comprise at least one of Nb and Ta in an amount of Nb+½ Ta: 1.5% or less; wherein the atomic % of Al+Ti+Nb+Ta is from 2.5 to 7.0.

In the low thermal expansion Ni-base superalloy, a part of Ni may be replaced by Co of 5% or less. In the low thermal expansion Ni-base superalloy, it is preferable that an average expansion coefficient at a temperature from room temperature to 700° C. is $14.0\times10^{-6}$/° C. or less.

DETAILED DESCRIPTION OF THE INVENTION

Figure 1:
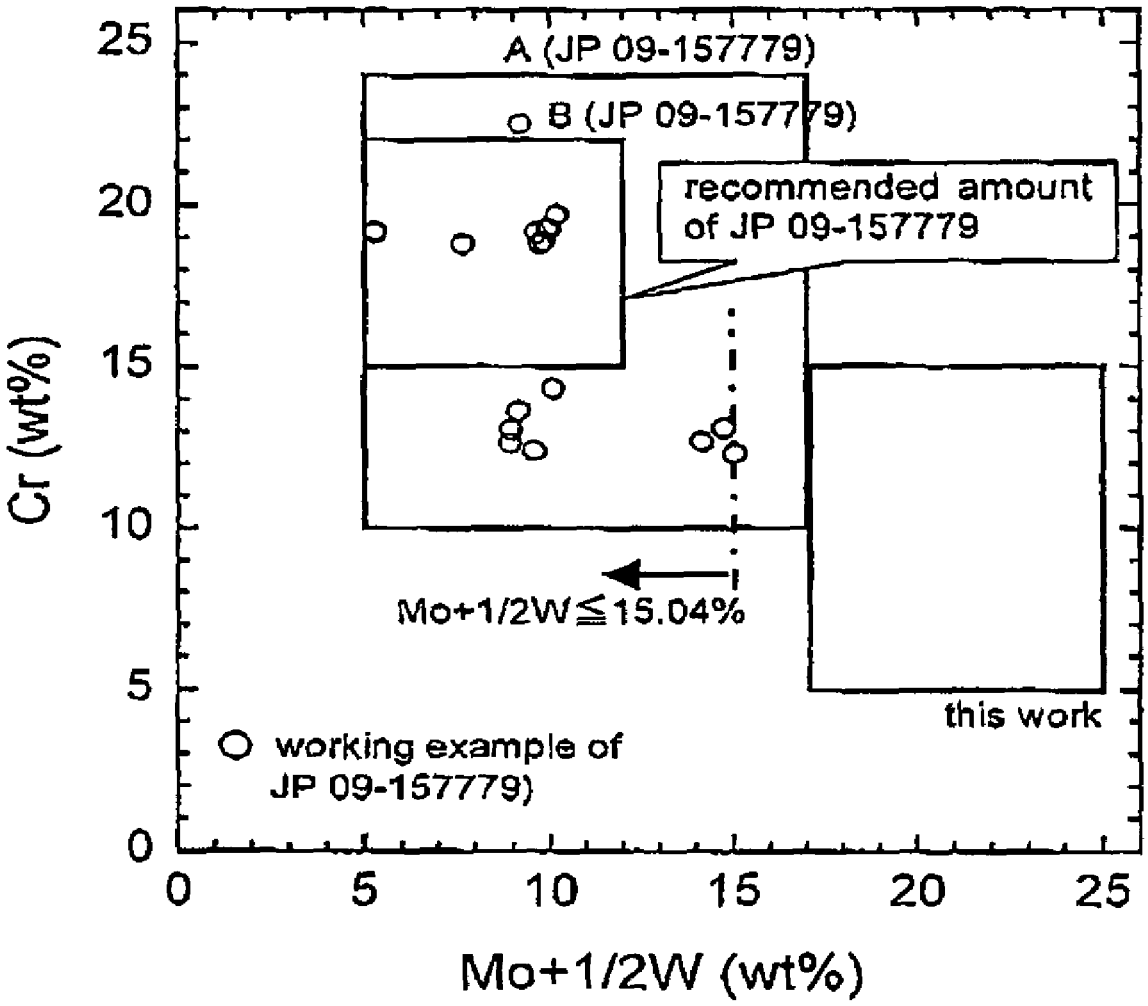
FIG. 1 is a photograph showing a microstructure (a transmission electron microphotograph) when the alloy of Example No. 1 was subjected to a heat treatment for precipitating the y' phase and the $A_2B$ phase (750° C.×24 hr/AC+650° C.×24 hr/AC).

An explanation will be given of the reason why the composition of the components is defined as described above.

C:0.15% or Less

Carbon (element C) is contained in the alloy to create carbide in combination with Ti, Nb, Cr and Mo, to enhance the high-temperature strength and prevent the size of the crystal grain from increasing. The contents of C exceeding 0.15% decreases the property of hot working so that it is 0.15% or less and preferably 0.10% or less.

Si: 1% or Less

Silicon (element Si) is added to the alloy of the present invention as a deoxidant and to increase the oxidation resistance. A content of Si exceeding 1% reduces ductility so that it is 1% or less, preferably 0.5% or less.

Mn: 1% or Less 4

Manganese (element Mn) is added as a deoxidant like Si. A Mn content exceeding 1% deteriorates the high temperature oxidation characteristic and also promotes precipitation of η phase (Ni, Ti) spoiling the ductility so that it is present in an amount of 1% or less, preferably 0.5% or less.

Cr: 5 to 20%

Chromium (element Cr) is contained in the alloy to improve the high temperature resistance and corrosion resistance through solid solution in the austenite phase. In order to maintain the sufficient high temperature oxidation resistance and corrosion resistance, although more contents of Cr is desired, it increases the thermal expansion coefficient so that it desired to be less from the standpoint of view of the thermal expansion.

In order to obtain a target thermal expansion coefficient in the vicinity of 650 to 700° C. which is a temperature at which the alloy of the present invention will be used, the chromium (element Cr) content of the alloy of 5 to 20% is desired. In order to obtain a lower thermal expansion coefficient, the content of Cr is preferably 5 to 15%, and a further lower thermal expansion coefficient is obtained with a Cr content which is preferably 5 to 10 (exclusive) %.

Mo+½ (W+Re): 17 (Exclusive to 25%

Elements Mo, W and Re are contained in the alloy of the present invention in order to increase the high temperature strength through strengthening of the solid solution in the austenite phase and reducing the thermal expansion coefficient. In order to obtain the thermal expansion coefficient intended by the invention, the total of one or more kinds of Mo+½ (W+Re) is more than 17%. When the total amount of these components exceeds 25% there is a reduction in the property of hot working and precipitates the embrittling phase to reduce the ductility so that the contents of Mo+½ (W+Re) is set at 17 (exclusive) to 25%.

Molybdenum (element Mo) is the most important element to create $A_2B$ phase ($Ni_2Mo$) in combination with Ni and adds strength by precipitation. To precipitate $A_2B$ phase, Mo contents of the alloy of the present invention must be more than 17% precipitation of $A_2B$ phase also decrease thermal expansion coefficient.

Ti: 0.5 to 4.5%

Titanium (element Ti) is contained in the alloy of the present invention to strengthen the y' phase formed in combination with Ni, reduce the thermal expansion coefficient and promote the effect of aging precipitation not only in the y' phase but also in the $A_2B$ phase. In order to provide such an effect, the Ti contents of the alloy of the present invention must be 0.5% or more. However, a Ti content of 4.5% or more precipitates the η phase (Ni, Ti) of the embrittling phase to reduce ductility so that it is set at 0.5 to 4.5%. In order to obtain sufficient strength and a low thermal expansion coefficient at a temperature of 700° C. at which the alloy of the invention is intended to be used, the contents of Ti preferably exceeds 3.5% and is 4.5% or less.

Al: 0.2 to 2.0%

Aluminium (element Al) is the most important element to create the y' phase in combination with Ni and adds strength by precipitation, and is contained in the alloy to promote the effect of aging precipitation in the $A_2B$ phase. An Al content of less than 0.2% provides insufficient precipitation of the y' phase. Where a large quantity of Ti, Nb and Ta makes the y' phase unstable and precipitates η phase and phase to cause embrittlement. The contents of 2.0% or more deteriorates the property of hot working and makes it impossible to forge a component. Therefore, the contents is set at 0.2 to 2.0% and preferably 0.2 to 0.4 (exclusive) %.

Fe: 10% or Less

Iron (element Fe) is contained as an impurity when inexpensive scrap or inexpensive mother alloy containing W, Mo, etc. is used in order to reduce the cost of the alloy. The presence of Fe decreases the high temperature strength and increases the thermal expansion coefficient. Although a lower content thereof is preferred, a content of 10% or less slightly influences the high temperature strength so that it is set at 10% or less. Preferably, it is 5% or less, and more preferably, it is 2% or less.

B: 0.02% or Less, Zr: 0.2% or Less

Elements B and Zr segregates in a crystal grain boundary to increase the creep strength. In addition, the boron, (B) can suppress the precipitation of η-phase in the alloy containing a larger quantity of Ti. These elements, B and Zr, are contained in the alloy to provide such an effect. Excessive content of these elements deteriorates the property of hot working and excessive Zr spoils the creep characteristic. For these reasons, the content of B is set at 0.02% (or less) and that of Zr is set at 0.2% or less.

Co: 5% or Less

Cobalt, Co is contained to increase the high temperature strength in solid solution in the alloy. However, the effect is relatively low as compared with the other elements and cobalt is expensive. For this reason, the content thereof is set at 5% or less.

Nb+½ Ta: 1.5% or Less

Elements Nb and Ta can form the y' phase ($Ni_3$ (Al, Nb, Ta) which is a precipitation strengthening phase of Ni-base superalloys and has the effect of strengthening the y' phase and preventing the coarsening of y' phase. These elements are contained in the alloy of the present invention to provide such an effect. Excessive content thereof precipitates the δ phase ($Ni_3$ (Nb, Ta) and results in lower ductility. For this reason, the content of Nb+½ Ta is set at 1.5%. The desired range is 1.0% or less.

Ni: Remainder

Nickel (element Ni) is an main element to create austenite which serves as a matrix, and can increase heat-resistance and corrosion-resistance. In addition, Ni forms the y' phase and $A_2B$ phase which are a precipitation strengthening phase.

Al+Ti: 2.5 to 7.0% by Atomic %, Al+Ti+Nb+Ta: 2.5 to 7.0% by atomic %

Elements Al, Ti, Nb and Ta are constituents of the y' phase. Therefore, where there is sufficient quantity of Ni, the volume fraction of the precipitated y' phase is proportional to the total of the atomic percent of these elements. Further, the high temperature strength is proportional to the volume traction of the y' phase so that it increases with the total of these elements. Therefore, the content of 2.5% or more is required to acquire the sufficient strength. However, the contents exceeding 7.0 excessively increases the volume fraction of the y' phase to deteriorate the property of hot working remarkably. For this reason, the content is set at 2.5 to 7.0% by atomic %, preferably 3.5 to 6.0%.

Other elements

As regards elements Mg, Ca, P, S and Cu, the property of the low thermal expansion Ni-base superalloy according to the invention will not be deteriorated as long as Mg: 0.03% or less, Ca: 0.03% or less, P: 0.05% or less, S: 0.001% or less, and Cu: 2% or less.

The low thermal expansion Ni-base superalloy according to the invention can be prepared by conventional methods for preparing Ni-base superalloys. After solid solution treatment not less than 950° C., age-hardening treatment is required. As alloys in this invention precipitation y' phase, a single step aging(650 to 850° C.) is effective. Alloys containing more than 17% Mo in this invention can precipitate $A_2B$ phase at the temperature from 550 to 700° C. so that a two-step aging (first step (y' precipitation): 650 to 850° C., second step($A_2B$ precipitation): 550 to 700° C.) is also effective. In two-step aging treatment, the first step aging promotes $A_2B$ precipitation strengthening in second step aging.

EXAMPLES

Various examples of the present invention will be explained below.

The alloy components having the compositions as shown in Table 1 was melted in a vacuum induction furnace having a capacity of 50 kg and an ingot weighing 50 kg was cast. The surface of an ingot was cut away and the ingot was heat-treated for 15 hours at 1150° C. as a homogenizing treatment. Thereafter, the ingot was forged into bars each having 60 mm square. The forged bars were heated for 2 hours at 1100° C., and thereafter water-cooled for its solid solution. The bars were subjected to hardening treatment aging for 16 hours at 750° C. Sample pieces cut from the bars were subjected to various tests. Thus, the test results as shown in Table 2 were obtained.

As regards the thermal expansion coefficient, using quartz as a standard sample, the average thermal expansion coefficient from room temperature to 70° C. was measured by a dilatometer available from RIGAKU DENSI CO. LTD. The measurement was carried out under the condition of a temperature rising speed of 5° C./min on the basis of a differential dilatometry. The sample used has a size of ϕ5.0×L19.0.

The high temperature tensile test was carried out for a tensile specimen with ridges having a parallel portion of 6 mm in diameter at 700° C. on the basis of the LN JIS high temperature tensile test method.

The creep rupture test was carried out for a specimen with a parallel portion having 6.4 mm in diameter at 700° C. under load stress of 343 MPa.

The steam oxidation test which is problematic in a steam turbine was carried out for the specimen having a width of 10 mm, length of 10 mm and thickness of 5 mm for 100 hr at 600° C., thereby measured the weight gain of oxidation after the test. The test was carried out in an environment of atmospheric pressure, water-vapor concentration of 83% and a water-steam flow rate of 7.43 1/s.

TABLE 1

| No. | C | Si | Mn | Ni | Fe | Co | Cr | Re | W | Wo | Ta | Nb | Al | Ti | Zr | B | Mo + (W + Re)/2 | Al + Ti + Nb + Ti |
|---|---|---|---|---|---|---|---|---|---|---|---|---|---|---|---|---|---|---|
| 1 | 0.06 | 0.15 | 0.25 | * | 0.47 | | 12.01 | | | 19.25 | | | 1.51 | 0.91 | | 0.008 | 19.25 | 5.2 |
| 2 | 0.02 | 0.31 | 0.21 | * | 0.96 | | 14.11 | | | 17.08 | | | 0.70 | 2.40 | 0.04 | 0.004 | 17.08 | 4.6 |
| 3 | 0.05 | 0.09 | 0.12 | * | 0.21 | | 18.12 | | | 17.21 | | | 0.51 | 1.98 | 0.03 | 0.003 | 17.21 | 3.6 |
| 4 | 0.06 | 0.11 | 0.12 | * | 0.48 | | 10.12 | | 4.92 | 17.51 | | | 0.48 | 2.42 | 0.06 | 0.011 | 19.97 | 4.3 |
| 5 | 0.04 | 0.08 | 0.09 | * | 1.02 | | 11.91 | | | 19.07 | | | 0.61 | 3.21 | 0.03 | 0.005 | 19.07 | 5.5 |
| 8 | 0.03 | 0.06 | 0.06 | * | 0.54 | 1.92 | 7.16 | | 4.96 | 15.04 | | | 1.11 | 1.65 | 0.03 | 0.005 | 17.52 | 4.7 |
| 7 | 0.05 | 0.06 | 0.11 | * | 0.36 | 2.14 | 10.12 | | 4.12 | 19.18 | | 0.7 | 1.10 | 1.61 | 0.03 | 0.004 | 21.24 | 5.2 |
| 8 | 0.04 | 0.21 | 0.42 | * | 0.97 | | 7.82 | | 4.21 | 19.11 | | | 1.20 | 1.60 | 0.05 | 0.003 | 21.22 | 4.9 |
| 9 | 0.04 | 0.05 | 0.08 | * | 0.51 | | 9.03 | 1.11 | 3.90 | 18.67 | | | 0.80 | 2.30 | 0.02 | 0.006 | 21.18 | 4.9 |
| 10 | 0.03 | 0.07 | 0.10 | * | 0.34 | | 7.11 | | 4.08 | 20.12 | | | 1.05 | 1.71 | 0.04 | 0.003 | 22.16 | 4.7 |
| 11 | 0.02 | 0.09 | 0.09 | * | 0.51 | | 9.01 | | 4.90 | 17.01 | | | 0.45 | 2.01 | 0.05 | 0.007 | 19.46 | 3.7 |
| 12 | 0.02 | 0.09 | 0.11 | * | 0.21 | | 9.01 | | 5.10 | 17.12 | 0.5 | 0.5 | 0.51 | 2.41 | 0.03 | 0.003 | 19.87 | 4.9 |
| 13 | 0.03 | 0.10 | 0.08 | * | 0.32 | | 9.10 | | 4.95 | 16.51 | | 0.5 | 0.49 | 2.51 | 0.03 | 0.002 | 18.99 | 4.8 |
| 14 | 0.02 | 0.12 | 0.13 | * | 0.24 | | 12.13 | | | 19.13 | | 0.5 | 0.38 | 2.49 | 0.03 | 0.003 | 19.13 | 4.4 |
| 15 | 0.03 | 0.11 | 0.21 | * | 0.12 | | 9.13 | | 5.01 | 16.91 | | | 0.38 | 3.61 | 0.03 | 0.002 | 19.42 | 5.7 |
| 16 | 0.03 | 0.09 | 0.12 | * | 0.24 | | 9.23 | | | 17.12 | | 0.6 | 0.35 | 3.54 | 0.03 | 0.002 | 17.12 | 5.7 |
| C1 | 0.12 | 0.04 | 0.72 | | * | | 10.51 | | 1.72 | 0.51 | | 0.1 | | | | V:0.2 | 1.37 | |
| C2 | 0.04 | 0.11 | 0.09 | * | 0.91 | | 19.11 | | | | | | 1.41 | 2.48 | | 0.004 | | 5.8 |
| C3 | 0.04 | 0.21 | 0.32 | * | 0.41 | 18.92 | 18.12 | | | 2.86 | | | 0.21 | 2.81 | | 0.003 | 2.86 | 3.8 |
| C4 | 0.03 | 0.07 | 0.08 | * | 24.51 | 35.30 | 3.21 | | | | | 3 | 5.39 | 0.21 | | 0.003 | | 13.0 |
| C5 | 0.03 | 0.09 | 0.07 | * | 41.80 | 13.02 | | | | | | 4.7 | 0.03 | 1.48 | | 0.003 | | 4.8 |
| C6 | 0.04 | 0.09 | 0.08 | * | 0.23 | | 9.12 | | 13.10 | 7.92 | | | 2.41 | 2.51 | 0.04 | 0.003 | 14.47 | 9.0 |
| C7 | 0.03 | 0.09 | 0.12 | * | 0.35 | | 11.23 | | 13.70 | 7.50 | | | 1.51 | 3.24 | 0.05 | 0.004 | 14.35 | 7.9 |
| C8 | 0.04 | 0.09 | 0.12 | * | 0.87 | | 19.12 | | 1.41 | 8.12 | | | 0.42 | 2.51 | 0.05 | 0.004 | 8.83 | 4.0 |
| C9 | 0.03 | 0.08 | 0.11 | * | 0.41 | | 14.12 | | 8.20 | 23.5 | | | 0.58 | 2.51 | 0.04 | 0.003 | 27.62 | 4.8 |
| C10 | 0.04 | 0.11 | 0.12 | * | 0.21 | | 10.12 | | 4.11 | 15.88 | | | 0.38 | 1.12 | 0.05 | 0.003 | 17.92 | 2.3 |

C1 to C10: Comparative Examples.

*Remainder

TABLE 2

| | Room temperature to 700° C. average thermal expansion coefficient (X10-6/° C.) | 700° C. Tensile strength (MPa) | 700° C./343 MPa creep rupture life (hr) | 600° C. × 500 hr weight gain of steam oxidation (mg/cm2) |
|---|---|---|---|---|
| 1 | 13.2 | 928 | 1131 | 0.09 |
| 2 | 13.8 | 996 | 1025 | 0.08 |
| 3 | 13.4 | 958 | 894 | 0.05 |
| 4 | 12.7 | 1001 | 1341 | 0.16 |
| 5 | 13.0 | 1109 | 981 | 0.15 |
| 6 | 12.9 | 890 | 1019 | 0.16 |
| 7 | 12.8 | 996 | 1216 | 0.11 |
| 8 | 12.7 | 970 | 1083 | 0.12 |
| 9 | 12.7 | 1017 | 899 | 0.11 |
| 10 | 12.5 | 980 | 1395 | 0.13 |
| 11 | 12.8 | 930 | 791 | 0.14 |
| 12 | 12.4 | 1007 | 2780 | 0.13 |
| 13 | 12.8 | 999 | 1987 | 0.15 |
| 14 | 13.1 | 1014 | 2108 | 0.11 |
| 15 | 12.5 | 1118 | 2880 | 0.16 |
| 16 | 13.1 | 1078 | 2541 | 0.14 |
| C1 | 12.4 | 178 | | 3.19 |
| C2 | 14.5 | 771 | 1011 | 0.17 |
| C3 | 16.1 | 774 | 1697 | 0.16 |
| C4 | 13.0 | 922 | 422 | 1.90 |
| C5 | 11.3 | 956 | 398 | 2.38 |
| C7 | | | | |
| C8 | 14.1 | 866 | 768 | 0.12 |
| C10 | 13.0 | 641 | 501 | 0.18 |

C1 to C10: Comparative Examples

As understood from the results shown in Table 2, all the samples. according to the invention have the average thermal expansion coefficient of $14.0\times10^{-6}$/° C. or less at the temperature from room temperature to 700° C., and tensile strength of 890 to 1118 MPa at 700° C. They have the creep rupture of 791 to 2880 hr, and the weight gain of steam oxidation of 0.05 to 0.21 mg/cm$^2$.

On the other hand, comparative example No. 1, which is 12 Cr ferritic steel, has a low average thermal expansion coefficient of $12.4\times10^{-6}$/° C. However, it's high temperature tensile strength is lower than the samples according to the invention. Comparative examples Nos. 2 and 3, which are Nimonic 80A and Refractaloy 26 known as a high temperature bolt material. These alloys have average thermal expansion coefficients of $14.5\times10^{-6}$° C. and $16.1\times10^{-6}$/° C., respectively which are higher than those of the samples according to the invention. Comparative examples Nos. 4 and 5, which are Inconel 783 and Incoloy 909, have average thermal expansion coefficients which are equal or lower than those of the samples according to the invention, but have worse steam oxidation characteristics than those according to the invention.

Comparative example No: 6, which has an Al content exceeding the upper limit of the invention and a total quantity of Al+Ti exceeding the upper limit of the invention, produced a crack in the material by water-cooling during the solid solution heat treatment. Comparative example No. 7, which has a total quantity of Al+Ti exceeding the upper limit of the invention, like the comparative example No. 6, produced a crack in the material by water-cooling during the solid solution heat treatment, and hence could not evaluated thereafter.

Comparative example No. 8, which is an alloy containing more Cr and a smaller value of Mo+½ (W+Re) than those of the samples according to the invention, has a larger average thermal expansion coefficient of $14.1\times10^{-6}$/° C. than those of the samples according to the invention.

Comparative example No. 9, which is an alloy having a larger value of Mo+½ (W+Re), has worse forgeability. This alloy produced a crack during the forging and could not evaluated thereafter.

Comparative example No. 10, which is lower in the total of Al+Ti than in the invention and insufficient in the precipitation amount of y' phase, has a smaller high-temperature strength than those of the samples according to the invention.

The low thermal expansion Ni-base superalloy according to the invention, which has the compositions as shown, has the average thermal expansion coefficient of 12.4 to $13.8\times10^{-6}$/° C. which is approximately equal to that of 12 Cr ferritic steel, and also has the creep rupture life of 791 to 2880 hr and weight gain of steam oxidation of 0.05 to 0.21 mg/cm$^2$. Thus, the Ni-base superalloy according, to the invention has an excellent effects of the high temperature strength and corrosion/oxidation resistance where are approximately equal to those of the austenite heat-resistant alloy.

The low thermal-expansion Ni-base superalloy can be applied to the bolt, blade and disk of a steam turbine, gas turbine and jet engine, and also applied to a boiler tube of a heating machine and pressurizing machine, thereby giving an excellent effect of improving the reliability of a thermal power plant.

Example No. 1-B

The alloys having the compositions as shown in Table 3 was melted in a vacuum induction furnace having a capacity of 50 kg, and its ingot having 50 kg was cast. The surface of an ingot was cut away and the ingot was heat-treated for 15 hours at 1150° C. as a homogenizing treatment, and then the ingot was forged into bars each having 60 mm square. The thus forged bars were subjected to a solution treatment by heating them for 2 hours at 1100° C. and then water-cooling. By carrying out three heat treatments of the alloy, namely y' phase precipitation heat treatment (750° C.×24 hr/AC), $A_2B$ phase precipitation heat treatment (650° C.×24 hr/AC) and a heat treatment for precipitating both of the y' phase and $A_2B$ phase (750° C.×24 hr/AC+650° C.×24 hr/AC), tensile test at 700° C. and measurement of thermal expansion coefficient from room temperature to 700° C. were carried out.

As regards the thermal expansion coefficient, using quartz as a standard sample, the average thermal expansion coefficient from room temperature to 700° C. was measured by a dilatometer available from RIGAKU DENSHI CO., LTD under the condition of a temperature rising speed of 5° C./min on the basis of a differential dilatometry. The sample used has a size of ϕ5.0×L 19.0. The high temperature tensile test was carried out for a tensile specimen with ridges having a parallel portion of 6 mm in diameter at 700° C. on the basis of the JIS high temperature tensile test method.

The results are shown in Table 4. By carrying out the heat treatment for precipitating both of the γ' phase and $A_2B$ phase, the tensile strength at 700° C. of each of the alloy of the examples of the invention became higher than the cases of precipitating the γ' phase and $A_2B$ phase each independently. Also, the thermal expansion coefficient was reduced by precipitating the $A_2B$ phase. The photograph in FIG. 1 shows a microstructure observed by transmission electron microscope when the alloy of example No. 1-B was subjected to the heat treatment for precipitating both of the γ' phase and $A_2B$ phase. The square precipitate is γ' phase and the oval precipitate is $A_2B$ phase, and it can be these two phases are precipitated as a complex.

Also, regarding the alloy of the invention in which the γ' phase and $A_2B$ phase were precipitated, the tensile strength at 700° C. is high and the average thermal expansion coefficient from room temperature to 700° C. is also low, in comparison with those of conventional alloy Nimonic 80A of comparative example No. BC 1 which is reinforced by precipitating the γ' phase alone. In addition, its tensile strength at 700° C. is also high in comparison with that of conventional alloy HA242 a comparative example BC 2 in which the $A_2B$ phase alone is precipitated.

The alloy of comparative example No. BC 3 is an alloy having almost the same composition of example No. 1-B, excluding Mo+(W+Re)/2, and a vale of its strength close to example No. 1-B can be obtained by the γ' phase precipitation heat treatment. However, this alloy has a Mo+(W+Re)/2 value of 15.17% which is 17% or lower of the invention, does not precipitate the $A_2B$ phase and shows low strength by the precipitation heat treatment of $A_2B$ phase, and even when a heat treatment for precipitating both of the $A_2B$ phase and γ' phase is carried out, the large increase in the strength like the case of the invention cannot be obtained, in comparison with the case of carrying out heat treatment of the γ' phase. In addition, because the Mo+(W+Re)/2 amount is lower than the invention, its thermal expansion coefficient is $14.2\times10^{-6}$/° C. which is higher than that of the alloy of the invention.

Example No. 1-D

The alloy shown in Table 5 was subjected to melting, forging and solution treatment by the same method of example No. 1-B, and a heat treatment for precipitating the γ' phase and $A_2B$ phase was carried out as shown in Table 6. In this connection, the alloy of example No. 6-D is a case in which the precipitation of γ' phase and $A_2B$ phase was carried out at same time under a condition of 700° C.×24 hr/AC. Also, for the Invar alloy Inconel 783 and Incoloy 909 of comparative example Nos. DC 5 and DC 6, heat treatments of 1015° C.×1 hr/WC+840° C.×3 hr/AC+720° C.×8 hr→(cooling speed 56° C./hr)→620° C.×8 hr/AC and 980° C.×1 hr/WC+720° C.×8 hr→(cooling speed 56° C./hr)→620° C.×8 hr/AC were respectively carried out.

On these alloys, thermal expansion coefficient measurement, high temperature tensile test, creep rupture test and steam oxidation test which is problematic in a steam turbine member were carried out. The thermal expansion coefficient measurement and high temperature tensile test were carried out by the similar methods as in the case of example No. 1-B. The creep rupture test was carried out using a test specimen with a parallel portion having 6.4 mm in diameter at 700° C. under a load stress of 343 MPa. The steam oxidation was carried out using a test specimen having a width of 10 mm, length of 10 mm and thickness of 5 mm at a temperature of 700° C. for 1000 hours, and the weight gain of oxidation after the test was measured. The test environment was atmospheric pressure, water-vapor concentration of 83% and water-steam flow rate of 7.43 l/s.

The results are shown in Table 6. As can be seen from these results, the example alloys of the invention showed an average thermal expansion coefficient from room temperature to 700° C. of 12.2 to $13.4\times10^{-6}$/° C. and a tensile strength at 700° C. of from 793 to 1183 MPa. Also, the creep rupture life was from 1536 to 2723 hours and the weight gain of the steam oxidation was from 0.32 to 0.81 mg/cm$^2$.

On the other hand, comparative example No. DC 1, which is 12 Cr ferritic steel, has a low average thermal expansion coefficient of $12.4\times10^{-6}$/° C., but its high temperature tensile strength and steam oxidation resistance were markedly lower than the samples according to the invention. Also, comparative example Nos. DC 2 and DC 3 are Nomonic 80A and Refractaloy 26 known as a high temperature bolt material, and these alloys have average thermal expansion coefficients of $14.5\times10^{-6}$/° C. and $16.1\times10^{-6}$/° C., respectively, which are higher than those of the samples according to the invention. Comparative example No. DC 4 is HA242, and its average thermal expansion coefficient and steam oxidation resistance are similar to those of the alloys developed by the invention, but since it is a precipitation reinforced alloy only by $A_2B$ phase, its high temperature tensile strength is lower than the developing target. Comparative example Nos. DC 5 and DC 6, which are Inconel 783 and Incoloyl 909, have average thermal expansion coefficients which are equal to or lower than those of the samples according to the invention, but have worse steam oxidation characteristics than those according to the invention.

Comparative example No. DC 7, which is an alloy having the Al and Ti content exceeding the upper limit of the invention and a total quantity of Al+Ti also exceeding the upper limit of the invention, produced a crack in the material by water-cooling after the solid solution heat treatment. Also, comparative example No. DC 8, which has a total quantity of Al+Ti also exceeding the upper limit of the invention, produced a crack in the material by water-cooling during the solid solution heat treatment similar to the case of comparative example No. DC 7, and hence could not evaluate thereafter. Comparative example No. DC 9, which is an alloy containing more Cr and having a smaller value of Mo+½ (W+Re) than those of the samples according to the invention, has a larger average thermal expansion coefficient of $14.1\times10^{-6}$/° C. Comparative example No. DC 10, which is an alloy having a larger value of Mo+½ (W+Re) than those of the samples according to the invention, has worse forgeability so that it produced a crack during the forging and could not evaluate thereafter.

TABLE 3

| No. | C | Si | Mn | Ni | Fe | Cr | W | Mo | Nb | Al | Ti | Zr | B | Mo + (W + Re)/2 | Al + Ti + Nb + Ta (atom %) | Remarks |
|---|---|---|---|---|---|---|---|---|---|---|---|---|---|---|---|---|
| 1-B | 0.030 | 0.08 | 0.04 | * | 0.78 | 12.09 | — | 18.35 | — | 0.91 | 1.25 | 0.06 | 0.005 | 18.35 | 3.66 | — |
| 2-B | 0.020 | 0.09 | 0.06 | * | 1.02 | 10.10 | 4.02 | 18.26 | — | 0.81 | 1.16 | 0.05 | 0.003 | 20.27 | 3.43 | — |
| 3-B | 0.040 | 0.09 | 0.08 | * | 0.52 | 8.17 | — | 20.01 | 0.50 | 0.75 | 1.23 | 0.04 | 0.004 | 20.01 | 3.65 | — |
| BC 1 | 0.040 | 0.11 | 0.09 | * | 0.91 | 19.11 | — | — | — | 1.41 | 2.64 | — | 0.004 | — | 5.82 | Nimonic80A |
| BC 2 | 0.015 | 0.10 | 0.03 | * | 0.70 | 7.80 | — | 24.90 | — | 0.08 | — | — | 0.006 | 25.02 | 0.19 | HA242 |
| BC 3 | 0.030 | 0.07 | 0.04 | * | 0.51 | 12.51 | — | 15.17 | — | 0.87 | 1.19 | 0.05 | 0.01 | 15.17 | 3.45 | — |

BC1 to BC3: Comparative examples
*Remainder

TABLE 4

| | $\gamma^1$ Phase precipitation heat-treatment (800° C. × 24 hr/AC) | | $A_2B$ Phase precipitation heat-treatment (650° C. × 24 hr/AC) | |
|---|---|---|---|---|
| No. | 700° C. Tensile strength (Mpa) | Room temperature to 700° C. thermal expansion coefficient ($\times 10^{-6}$/° C.) | 700° C. Tensile strength (Mpa) | Room temperature to 700° C. thermal expansion coefficient ($\times 10^{-6}$/° C.) |
| 1-B | 741 | 13.2 | 631 | 13.0 |
| 2-B | 781 | 12.9 | 712 | 12.7 |
| 3-B | 732 | 13.0 | 784 | 12.8 |
| BC1 | 771 | 14.5 | — | — |
| BC2 | — | — | 707 | 12.5 |
| BC3 | 716 | 14.1 | 423 | 14.2 |

| | $\gamma^1$ Phase and $A_2B$ phase precipitation heat-treatments | |
|---|---|---|
| No. | 700° C. Tensile strength (Mpa) | Room temperature to 700° C. thermal expansion coefficient ($\times 10^{-6}$/° C.) |
| 1-B | 981 | 13.0 |
| 2-B | 1102 | 12.7 |
| 3-B | 1076 | 12.8 |
| BC1 | — | — |
| BC2 | — | — |
| BC3 | 735 | 14.2 |

BC1 to BC3: Comparative examples
[1]750° C. × 24 hr/AC + 650° C. × 24 hr/AC

TABLE 5

| No. | C | Si | Mn | Ni | Fe | Co | Cr | Re | W | Mo | Ta | Nb | Al | Ti | Zr | B | Mo + (W + Re)/2 | Al + Ti + Nb + Ta (atom %) | Remarks |
|---|---|---|---|---|---|---|---|---|---|---|---|---|---|---|---|---|---|---|---|
| 1-D | 0.03 | 0.21 | 0.14 | * | 0.51 | | 12.23 | | | 18.30 | | | 0.91 | 1.23 | | 0.003 | 18.30 | 3.62 | |
| 2-D | 0.04 | 0.31 | 0.35 | * | 8.17 | | 11.87 | | | 18.31 | | | 1.21 | 1.62 | 0.04 | 0.006 | 18.31 | 4.75 | |
| 3-D | 0.04 | 0.13 | 0.26 | * | 1.21 | | 8.24 | | 2.16 | 23.15 | | | 0.56 | 0.91 | | 0.004 | 24.23 | 2.54 | |
| 4-D | 0.05 | 0.32 | 0.25 | * | 0.43 | | 8.54 | 0.54 | | 23.42 | | | 1.16 | 0.94 | 0.06 | 0.003 | 23.69 | 3.92 | |
| 5-D | 0.09 | 0.11 | 0.21 | * | 0.54 | | 17.24 | | | 17.21 | | | 0.65 | 1.28 | 0.04 | 0.005 | 17.21 | 3.07 | |
| 6-D | 0.04 | 0.31 | 0.24 | * | 1.32 | | 12.10 | | | 18.61 | | 0.86 | 0.91 | 1.01 | 0.03 | 0.006 | 18.61 | 3.92 | |
| 7-D | 0.03 | 0.26 | 0.24 | * | 0.56 | | 14.41 | | | 17.96 | 1.02 | 0.53 | 0.45 | 0.62 | 0.06 | 0.001 | 17.96 | 2.53 | |
| 8-D | 0.03 | 0.25 | 0.31 | * | 0.23 | | 7.21 | | | 17.39 | | | 0.21 | 3.62 | 0.03 | 0.003 | 17.39 | 5.11 | |
| 9-D | 0.03 | 0.18 | 0.12 | * | 0.11 | | 6.93 | | | 18.23 | | | 1.82 | 1.65 | 0.03 | 0.006 | 18.23 | 6.19 | |
| 10-D | 0.05 | 0.23 | 0.27 | * | 0.78 | | 10.91 | | 0.31 | 19.15 | | | 0.32 | 1.91 | 0.04 | 0.005 | 19.31 | 3.19 | |
| 11-D | 0.04 | 0.07 | 0.09 | * | 0.39 | | 6.14 | 1.12 | 5.61 | 18.62 | | | 0.33 | 1.87 | 0.03 | 0.004 | 21.99 | 3.34 | |
| 12-D | 0.03 | 0.06 | 0.06 | * | 0.53 | | 10.63 | | 0.67 | 21.54 | | | 0.65 | 1.01 | 0.03 | 0.005 | 21.88 | 2.83 | |
| 13-D | 0.02 | 0.07 | 0.1 | * | 0.51 | | 10.23 | | 4.01 | 20.20 | | | 0.71 | 0.76 | 0.02 | 0.006 | 22.21 | 2.69 | |
| 14-D | 0.05 | 0.07 | 0.11 | * | 0.44 | | 9.42 | | 1.02 | 22.30 | | | 0.71 | 1.02 | 0.03 | 0.003 | 22.81 | 3.00 | |
| 15-D | 0.03 | 0.06 | 0.08 | * | 0.36 | | 10.56 | | 0.78 | 24.56 | | 0.56 | 1.45 | 0.61 | 0.03 | 0.004 | 24.95 | 4.57 | |
| 16-D | 0.03 | 0.05 | 0.09 | * | 0.34 | | 8.11 | | | 20.45 | 0.51 | 0.52 | 0.54 | 0.92 | 0.04 | 0.003 | 20.45 | 2.99 | |
| 17-D | 0.02 | 0.07 | 0.16 | * | 0.92 | | 9.13 | | 4.11 | 18.97 | 1.02 | 1.02 | 0.51 | 0.82 | 0.03 | 0.004 | 21.03 | 3.40 | |
| 18-D | 0.05 | 0.06 | 0.06 | * | 0.55 | | 9.76 | | 2.32 | 23.50 | | | 0.45 | 1.23 | 0.03 | 0.004 | 24.66 | 2.71 | |
| 19-D | 0.03 | 0.03 | 0.1 | * | 0.51 | 4.02 | 10.12 | | 2.45 | 17.40 | | | 0.82 | 1.2 | 0.05 | 0.014 | 18.63 | 3.45 | |
| 20-D | 0.09 | 0.03 | 0.09 | * | 0.64 | 3.25 | 9.87 | | 3.67 | 17.12 | | 0.45 | 1.24 | 1.54 | 0.06 | 0.004 | 18.96 | 5.17 | |

TABLE 5-continued

| No. | C | Si | Mn | Ni | Fe | Co | Cr | Re | W | Mo | Ta | Nb | Al | Ti | Zr | B | Mo + (W + Re)/2 | Al + Ti + Nb + Ta (atom %) | Remarks |
|---|---|---|---|---|---|---|---|---|---|---|---|---|---|---|---|---|---|---|---|
| 21-D | 0.02 | 0.08 | 0.09 | * | 0.67 | 2.01 | 9.01 | | 4.9 | 17.01 | | | 0.45 | 1.76 | 0.05 | 0.070 | 19.46 | 3.38 | |
| DC1 | 0.12 | 0.04 | 0.72 | | * | | 10.51 | | 1.72 | 0.51 | | 0.10 | | | | V:0.2 | 1.37 | | 12Cr steel |
| DC2 | 0.04 | 0.11 | 0.09 | * | 0.91 | | 19.11 | | | | | | 1.41 | 2.46 | | 0.004 | | 5.80 | Nimonic 80A |
| DC3 | 0.04 | 0.21 | 0.32 | * | 0.41 | 18.92 | 18.12 | | | 2.86 | | | 0.21 | 2.81 | | 0.003 | 2.86 | 3.80 | Refract-aloy26 |
| DC4 | 0.015 | 0.10 | 0.03 | * | 0.7 | 1.13 | 7.80 | | | 24.9 | 0.01 | | 0.08 | | | 0.006 | 25.02 | 0.19 | HA242 |
| DC5 | 0.03 | 0.07 | 0.08 | * | 24.51 | 35.3 | 3.21 | | | | | 3.00 | 5.39 | 0.21 | | 0.003 | | 13.00 | Inconel 783 |
| DC6 | 0.03 | 0.09 | 0.07 | * | 41.8 | 13.02 | | | | | | 4.70 | 0.03 | 1.48 | | 0.003 | | 4.80 | Incoloy 909 |
| DC7 | 0.03 | 0.08 | 0.06 | * | 0.21 | | 10.11 | | 2.11 | 23.41 | | | 2.21 | 2.14 | 0.04 | 0.003 | 24.47 | 7.90 | |
| DC8 | 0.04 | 0.09 | 0.09 | * | 0.35 | | 11.23 | | 1.76 | 24.32 | | | 1.97 | 1.95 | 0.05 | 0.004 | 25.20 | 7.11 | |
| DC9 | 0.04 | 0.07 | 0.11 | * | 0.78 | | 21.45 | | 0.54 | 10.65 | | | 0.42 | 2.51 | 0.05 | 0.004 | 10.92 | 4.00 | |
| DC 10 | 0.04 | 0.08 | 0.11 | * | 0.31 | | 14.12 | | 5.12 | 27.8 | | | 0.98 | 1.26 | 0.04 | 0.003 | 30.36 | 4.12 | |

DC1 to DC10: Comparative examples

*remainder

TABLE 6

| No. | γ'Phase precipitation heat-treatment | $A_2B$ Phase precipitation heat-treatment | Room temperature to 700° C. average thermal expansion coefficient ($\times 10^{-6}$ /° C.) | 700° C. Tensile strength (Mpa) | 700° C. × 343 MPa Creep rupture time (h) | 700° C. × 1000 h Weight gain of steam oxidation (mg/cm$^2$) |
|---|---|---|---|---|---|---|
| 1-D | 800° C. × 16 hr/AC | 650° C. × 96 hr/AC | 13.2 | 991 | 2135 | 0.48 |
| 2-D | 800° C. × 24 hr/AC | 650° C. × 24 hr/AC | 13.4 | 1032 | 2321 | 0.52 |
| 3-D | 725° C. × 24 hr/AC | 625° C. × 24 hr/AC | 12.6 | 891 | 1536 | 0.74 |
| 4-D | 750° C. × 24 hr/AC | 675° C. × 24 hr/AC | 12.7 | 1022 | 1953 | 0.72 |
| 5-D | 750° C. × 24 hr/AC | 650° C. × 24 hr/AC | 13.4 | 1014 | 1986 | 0.32 |
| 6-D | 700° C. × 24 hr/AC | | 13.4 | 890 | 1867 | 0.48 |
| 7-D | 750° C. × 24 hr/AC | 650° C. × 24 hr/AC | 12.7 | 793 | 1695 | 0.48 |
| 8-D | 800° C. × 24 hr/AC | 650° C. × 24 hr/AC | 12.9 | 1103 | 2412 | 0.56 |
| 9-D | 825° C. × 16 hr/AC | 650° C. × 24 hr/AC | 13.0 | 1183 | 2723 | 0.67 |
| 10D | 750° C. × 24 hr/AC | 650° C. × 24 hr/AC | 13.0 | 942 | 1734 | 0.48 |
| 11D | 750° C. × 24 hr/AC | 650° C. × 24 hr/AC | 12.5 | 954 | 1876 | 0.81 |
| 12D | 750° C. × 24 hr/AC | 650° C. × 24 hr/AC | 12.9 | 901 | 1554 | 0.45 |
| 13D | 750° C. × 24 hr/AC | 650° C. × 24 hr/AC | 12.7 | 892 | 1767 | 0.45 |
| 14D | 750° C. × 24 hr/AC | 625° C. × 96 hr/AC | 12.7 | 871 | 1756 | 0.43 |
| 15D | 800° C. × 24 hr/AC | 675° C. × 24 hr/AC | 12.7 | 1121 | 2483 | 0.45 |
| 16D | 750° C. × 24 hr/AC | 650° C. × 24 hr/AC | 12.7 | 910 | 1653 | 0.61 |
| 17D | 750° C. × 24 hr/AC | 650° C. × 24 hr/AC | 12.2 | 912 | 2057 | 0.47 |
| 18D | 750° C. × 24 hr/AC | 675° C. × 24 hr/AC | 12.5 | 852 | 1756 | 0.43 |
| 19D | 750° C. × 24 hr/AC | 650° C. × 24 hr/AC | 13.1 | 902 | 2135 | 0.47 |
| 20D | 800° C. × 24 hr/AC | 650° C. × 24 hr/AC | 13.1 | 1103 | 2504 | 0.50 |
| 21D | 750° C. × 24 hr/AC | 650° C. × 24 hr/AC | 12.8 | 914 | 1988 | 0.51 |
| DC1 | | | 12.4 | 178 | | 19.97 |
| DC2 | 705° C. × 16 hr/AC | | 14.5 | 771 | 1011 | 3.12 |
| DC3 | (1) | | 16.1 | 774 | 1697 | 0.61 |
| DC4 | | 650° C. × 24 hr/AC | 12.5 | 710 | 1416 | 0.41 |
| DC5 | | | 13.0 | 922 | 422 | 9.06 |
| DC6 | | | 11.3 | 956 | 398 | 14.61 |
| DC7 | | | | | | |
| DC8 | | | | | | |
| DC9 | 825° C. × 16 hr/AC | 650° C. × 24 hr/AC | 14.1 | 963 | 1662 | 0.34 |
| DC 10 | | | | | | |

DC1 to DC10: Comparative examples (1): 816° C. × 20 hr/AC + 732° C. × 20 hr/AC

What is claimed:

1. A low thermal expansion Ni-base superalloy comprising, by weight % (hereinafter the same as long as not particularly defined), C: 0.15% or less;

Si: 1% or less;

Mn: 1% or less;

Mo: 17.01 to 25%;

Cr: 5 to 15%;

at least one of Mo, W and Re of Mo+½(W+Re) of 17.39 to 25%;

Al: 0.2 to 2%;

Ti: 0.5 to 4.5%;

Fe of 10% or less;

at least one of B: 0.02% and Zr: 0.2% or less;

a remainder of Ni and inevitable impurities;

wherein the atomic % of Al+Ti is 2.5 to 7.0;

wherein the low thermal expansion Ni base superalloy contains both γ' phase precipitate consisting of intermetallic compound $Ni_3Al$, $Ni_3(Al, Ti)$ or $Ni_3(Al, Ti, Nb, Ta)$ and $A_2B$ phase precipitate consisting of intermetallic compound $Ni_2(Mo, Cr)$.

2. The low thermal expansion Ni-base superalloy according to claim 1, wherein the amount of Cr is from 5 to 10 (exclusive) %.

3. The low thermal expansion Ni-base superalloy according to claim 2, further comprising at least one of Nb and Ta in Nb+½ Ta: 1.5% or less; wherein the atomic % of Al+Ti+Nb+Ta is 2.5 to 7.0.

4. The low thermal expansion Ni-base superalloy according to claim 1, wherein the amount of Al is from 0.2 to 0.4 (exclusive) %.

5. The low thermal expansion Ni-base superalloy according to claim 4, further comprising at least one of Nb and Ta in Nb+½ Ta: 1.5% or less; wherein the atomic % of Al+Ti+Nb+Ta is 2.5 to 7.0.

6. The low thermal-expansion Ni-base superalloy according to claim 1, wherein the amount of Ti is from 3.5 (exclusive) to 4.5%.

7. The low thermal expansion Ni-base superalloy according to claim 6, further comprising at least one of Nb and Ta in Nb+½ Ta: 1.5% or less; wherein the atomic % of Al+Ti+Nb+Ta is 2.5 to 7.0.

8. The low thermal expansion Ni-base superalloy according to claim 1, wherein a part of Ni is replaced by Co of 5% or less.

9. The low thermal expansion Ni-base superalloy according to claim 1, wherein an average expansion coefficient at a temperature from room temperature to 700° C. is $14.0\times 10^{-6}/°$ C. or less.

* * * * *